US005948741A

United States Patent [19]

Ochomogo et al.

[11] Patent Number: 5,948,741

[45] Date of Patent: Sep. 7, 1999

[54] AEROSOL HARD SURFACE CLEANER WITH ENHANCED SOIL REMOVAL

[75] Inventors: Maria Ochomogo, Danville; Teressa Brandtjen, Pleasanton; Scott C. Mills, Livermore; Jennifer C. Julian, Castro Valley; Michael H. Robbins, Pleasanton, all of Calif.

[73] Assignee: The Clorox Company, Oakland, Calif.

[ * ] Notice: This patent is subject to a terminal disclaimer.

[21] Appl. No.: 08/827,546

[22] Filed: Mar. 28, 1997

Related U.S. Application Data

[63] Continuation of application No. 08/632,041, Apr. 12, 1996, Pat. No. 5,814,591, and application No. 08/731,653, Oct. 17, 1996.

[51] Int. Cl.[6] ..... C11D 3/33

[52] U.S. Cl. ..... 510/191; 510/238; 510/384; 510/434; 510/490; 510/503; 510/504; 134/198

[58] Field of Search ..... 510/191, 235, 510/237, 238, 384, 427, 434, 490, 503, 504; 134/198

[56] References Cited

U.S. PATENT DOCUMENTS

| | | | |
|---|---|---|---|
| H269 | 5/1987 | Malik . | |
| 4,029,607 | 6/1977 | Murtaugh . | |
| 4,158,644 | 6/1979 | Hammerel . | |
| 4,207,215 | 6/1980 | Bolan . | |
| 4,530,781 | 7/1985 | Gipp . | |
| 4,595,527 | 6/1986 | Gipp . | |
| 4,637,899 | 1/1987 | Kennedy, Jr. . | |
| 4,687,592 | 8/1987 | Collins et al. . | |
| 4,734,259 | 3/1988 | Frenier et al. . | |
| 4,749,516 | 6/1988 | Brusky . | |
| 4,844,744 | 7/1989 | Leiter et al. . | |
| 5,013,483 | 5/1991 | Frenier et al. . | |
| 5,062,987 | 11/1991 | Turcotte et al. . | |
| 5,071,582 | 12/1991 | Conville et al. . | |
| 5,252,245 | 10/1993 | Garabedian, Jr. et al. . | |
| 5,266,121 | 11/1993 | Cioletti . | |
| 5,328,561 | 7/1994 | Letize et al. . | |
| 5,380,454 | 1/1995 | Griepenburg et al. | 252/174.14 |
| 5,417,887 | 5/1995 | Skeele . | |
| 5,437,807 | 8/1995 | Garabedian, Jr. et al. . | |
| 5,439,901 | 8/1995 | Schwen et al. | 514/178 |
| 5,454,984 | 10/1995 | Graubart et al. . | |
| 5,468,423 | 11/1995 | Garabedian, Jr. et al. . | |
| 5,476,615 | 12/1995 | Hall et al. . | |
| 5,487,884 | 1/1996 | Bissett et al. | 424/59 |
| 5,585,342 | 12/1996 | Choy et al. . | |

FOREIGN PATENT DOCUMENTS

| | | |
|---|---|---|
| 2-180999 | 7/1990 | Japan . |

*Primary Examiner*—John R. Hardee
*Attorney, Agent, or Firm*—Mark E. Baze; Joel J. Hayashida

[57] ABSTRACT

An aerosol cleaning composition for hard surfaces is provided. The dispensable includes: (a) an anionic, nonionic, amphoteric surfactant, and mixtures thereof with optionally, a quaternary ammonium surfactant, the total amount of said surfactant being present in a cleaning effective amount; (b) at least one water-soluble or dispersible organic solvent having a vapor pressure of at least 0.001 mm Hg at 25° C., said at least one organic solvent present in a solubilizing—or dispersion—effective amount; (c) a chelating agent selected from the group consisting of tetrapotassium ethylenediamine-tetraacetate (potassium EDTA), tetraammonium ethylenediamine-tetraacetate (ammonium EDTA) and mixtures thereof, said chelating agent present in an amount effective to enhance soil removal in said composition; (d) an effective amount of a propellant; and (e) the remainder, water. The forming action of the aerosol composition facilitates the dispersement of the cleaning components.

21 Claims, No Drawings

AEROSOL HARD SURFACE CLEANER WITH ENHANCED SOIL REMOVAL

The present application is a continuation in part application of U.S. patent applications Ser. No. 08/632,041 now U.S. Pat. No. 5,814,591 filed Apr. 12, 1996 and 08/731,653, filed on Oct. 17, 1996.

FIELD OF THE INVENTION

The present invention relates generally to aerosol hard surface cleaners that are especially effective on bathroom soils, such as soap scum and particularly to a dispensable composition that forms a foam on the surface of stained and soiled surfaces which readily collapses to deliver the cleaning formulation.

BACKGROUND OF THE INVENTION

A number of hard surface cleaners have been specially formulated to target bathroom soils. These include products containing liquid hypochlorite for combating mildew and fungus; products with quaternary ammonium compounds as bacteriostats; and acidic cleaners, such as those containing phosphoric or other strong mineral acids. These cleaners will typically include buffers, dyes, fragrances, and the like in order to provide performance and/or aesthetic enhancements.

Gipp, U.S. Pat. No. 4,595,527, discloses a laundry prespotter consisting essentially of at least 5% nonionic surfactants and chelating agents, including ammonium EDTA, but which is substantially solvent-free.

Murtaugh, U.S. Pat. No. 4,029,607, discloses the use of ammonium EDTA in a drain opener, while Bolan, U.S. Pat. No. 4,207,215, discloses the use of ammonium EDTA in a thixotropic gel for tile cleaning. Neither of these two references, however, discloses, teaches or suggests the presence of a solvent, nor discloses, teaches or suggests the formulation of an aerosol bathroom cleaner with enhanced soil removal.

Graubart et al., U.S. Pat. No. 5,454,984, discloses a cleaning composition comprising quaternary ammonium compounds, tetrasodium EDTA, a mixture of surfactants, and a glycol ether. However, the reference fails to teach, disclose or suggest the use of either potassium or ammonium EDTA as a chelating agent.

Garabedian et al., U.S. Pat. Nos. 5,252,245, 5,437,807 and 5,468,423, and Choy et al., U.S. patent application Ser. No. 08/410,470, filed Mar. 24, 1995, all of common assignment herewith, disclose improved glass and surface cleaners which combine either amphoteric or nonionic surfactants with solvents and effective buffers to provide excellent streaking/filming characteristics on glass and other smooth, glossy surfaces.

Co-pending application Ser. No. 08/807,187 filed Feb. 27, 1996, a continuation of Ser. No. 08/507,543, filed Jul. 26, 1995, now abandoned, of Zhou et al., entitled "Antimicrobial Hard Surface Cleaner," of common assignment, discloses and claims an antimicrobial hard surface cleaner which includes amine oxide, quaternary ammonium compound and tetrasodium EDTA, in which a critical amine oxide: EDTA ratio results in enhanced non-streaking and non-filming performance.

Co-pending application Ser. No. 08/605,822, filed Feb. 23, 1996, of Choy et al., entitled "Composition and Apparatus for Surface Cleaning," of common assignment, discloses and claims a hard surface cleaner which uses a dual chamber delivery system, one chamber containing an oxidant solution and the other, a combination of chelating agents and surfactants.

However, none of the art discloses, teaches or suggests the use of tetrapotassium EDTA and/or tetraammonium EDTA as an effective chelating agent which additionally surprisingly enhances the soil removing, especially soap scum-removing, ability of the liquid, one phase cleaners formulated therewith. Additionally, none of the art discloses, teaches or suggests an aerosol formulation of these cleaning compositions.

SUMMARY OF THE INVENTION

The present invention is directed to a foam forming aerosol cleaning composition that is particularly suited for cleaning hard surfaces. The invention is based in part on the discovery that the aerosol formulations of a hard-surface cleaner that includes a chelating agent comprising potassium EDTA and/or ammonium EDTA are superior in applying the cleaner over a surface area without adversely affecting the cleaning abilities of the cleaner.

In one aspect, the invention is directed to a dispensable composition for cleaning hard surfaces that includes:

(a) an anionic, nonionic, amphoteric surfactant, and mixtures thereof with optionally, a quaternary ammonium surfactant, the total amount of said surfactant being present in a cleaning effective amount;

(b) at least one water-soluble or dispersible organic solvent having a vapor pressure of at least 0.001 mm Hg at 25° C., said at least one organic solvent present in a solubilizing—or dispersion—effective amount;

(c) a chelating agent selected from the group consisting of tetrapotassium ethylenediamine-tetraacetate (potassium EDTA), tetraammonium ethylenediamine-tetraacetate (ammonium EDTA) and mixtures thereof, said chelating agent present in an amount effective to enhance soil removal in said composition;

(d) an effective amount of a propellant; and (e) the remainder, water.

In another aspect, the invention is directed to a device, for dispensing a composition for cleaning hard surfaces, which includes, a closed container containing the above referenced cleaning composition and nozzle means for releasing said composition towards a soiled surface.

DETAILED DESCRIPTION OF PREFERRED EMBODIMENTS

The invention provides an aerosol formulation comprising an improved, all purpose cleaner especially adapted for the complete and speedy removal of soap scum and other bathroom soils from a hard surface. The cleaner is intended to clean hard surfaces by aerosol application of a metered discrete amount of the cleaner by a dispenser onto the surface to be cleaned and then wiping the surface, thus removing the soil and the cleaner, with or without the need for rinsing with water. Foaming action facilitates dispersal of the active components. The typical bathroom surface is a shower stall, both the glass doors, as well as the vertical wall surfaces (typically made of tile, or composite materials), sinks and glass.

The aerosol formulation comprises a cleaning composition that is mixed with a propellant. The cleaning composition or cleaner itself prior to being mixed with the propellant is preferably a single phase, clear, isotropic solution, having a viscosity generally less than about 100 Centipoise ("cps"). The cleaning composition itself has the following ingredients:

(a) an anionic, nonionic or amphoteric surfactant, and mixtures thereof with optionally, a quaternary ammonium surfactant, said surfactants being present in a cleaning—effective amount;

(b) at least one water-soluble or dispersible organic solvent having a vapor pressure of at least 0.001 mm Hg at 25° C., said at least one organic solvent present in a solubilizing—or dispersion—effective amount;

(c) a chelating agent selected from ammonium ethylenediamine-tetraaecetate (ammonia EDTA), tetrapotassium ethylenediamine-tetraacetate (potassium EDTA), or mixtures thereof, said chelating agent present in an amount effective to enhance soil, especially soap scum, removal in said cleaner; and (d) the remainder, water.

Additional adjuncts in small amounts such as buffers, fragrance, dye and the like can be included to provide desirable attributes of such adjuncts.

In the application, effective amounts are generally those amounts listed as the ranges or levels of ingredients in the descriptions which follow hereto. Unless otherwise stated, amounts listed in percentage ("%'s") are in weight percent (based on 100% active) of the cleaning composition.

1. Solvents

The solvent is a water soluble or dispersible organic solvent having a vapor pressure of at least 0.001 mm Hg at 25° C. It is preferably selected from $C_{1-6}$ alkanol, $C_{1-6}$ diols, $C_{3-24}$ alkylene glycol ethers, and mixtures thereof. The alkanol can be selected from methanol, ethanol, n-propanol, isopropanol, butanol, pentanol, hexanol, their various positional isomers, and mixtures of the foregoing. It may also be possible to utilize in addition to, or in place of, said alkanols, the diols such as methylene, ethylene, propylene and butylene glycols, and mixtures thereof.

It is preferred to use an alkylene glycol ether solvent in this invention. The alkylene glycol ether solvents can include ethylene glycol monobutyl ether, ethylene glycol monopropyl ether, propylene glycol n-propyl ether, propylene glycol monobutyl ether, diethylene glycol n-butyl ether, dipropylene glycol methyl ether, and mixtures thereof. Preferred glycol ethers are ethylene glycol monobutyl ether, also known as butoxyethanol, sold as butyl Cellosolve by Union Carbide, and also sold by Dow Chemical Co., 2-(2-butoxyethoxy) ethanol, sold as butyl Carbitol, also by Union Carbide, and propylene glycol n-propyl ether, available from a variety of sources. Another preferred alkylene glycol ether is propylene glycol, t-butyl ether, which is commercially sold as Arcosolve PTB, by Arco Chemical Co. The n-butyl ether of propylene glycol is also preferred. Other suppliers of preferred solvents include Union Carbide. If mixtures of solvents are used, the amounts and ratios of such solvents used are important to determine the optimum cleaning and streak/film performances of the inventive cleaner. It is preferred to limit the total amount of solvent to no more than 50%, more preferably no more than 25%, and most preferably, no more than 15%, of the cleaner. A preferred range is about 1–15%. These amounts of solvents are generally referred to as dispersion-effective or solubilizing effective amounts, since the other components, such as surfactants, are materials which are assisted into solution by the solvents. The solvents are also important as cleaning materials on their own, helping to loosen and solubilize greasy soils for easy removal from the surface cleaned.

2. Surfactants

The surfactant is an anionic, nonionic, amphoteric surfactant, or mixtures thereof. Optionally, a quaternary ammonium surfactant can be added.

a. Anionic, Nonionic and Amphoteric Surfactants

The anionic surfactant is, for example, a linear or branched $C_{6-14}$ alkylbenzene sulfonate, alkane sulfonate, alkyl sulfate, or generally, a sulfated or sulfonated $C_{6-14}$ surfactant. Witconate NAS, for example, is a 1-octane-sulfonate, from Witco Chemical Company. Pilot L-45, a $C_{11.5}$ alkylbenzene sulfonate (which are referred to as "LAS"), from Pilot Chemical Co., Biosoft S100 and S130 (non-neutralized linear alkylbenzene sulfonic acid, which is referred to as "HLAS") and S40 from Stepan Company; sodium dodecyl sulfate and sodium lauryl sulfate. The use of acidic surfactants having a higher actives level may be desirable due to cost-effectiveness.

The nonionic surfactants are selected from alkoxylated alcohols, alkoxylated phenol ethers, and other surfactants often referred to as semi-polar nonionics, such as the trialkyl amine oxides. The alkoxylated phenol ethers include octyl- and nonylphenol ethers, with varying degrees of alkoxylation, such as 1–10 moles of ethylene oxide per mole of phenol. The alkyl group can vary from $C_{6-16}$, although octyl- and nonyl chain lengths are readily available. Various suitable products available from Rohm and Haas under the trademark Triton, such as Triton N-57, N-101, N-111, X-45, X-100, X-102, and from Mazer Chemicals under the trademark Macol, from GAF Corporation under the trademark Igepal, from Texaco Chemical Company under the trademark Surfonic. The alkoxylated alcohols include ethoxylated, and ethoxylated and propoxylated $C_{6-16}$ alcohols, with about 2–10 moles of ethylene oxide, or 1–10 and 1–10 moles of ethylene and propylene oxide per mole of alcohol, respectively. Exemplary surfactants are available from Shell Chemical under the trademarks Neodol and Alfonic and Huntsman. The semi-polar amine oxides are also preferred, although, for the invention, a mixture of nonionic and amine oxide surfactants can also be used. The amine oxides, referred to as mono-long chain, di-short chain, trialkyl amine oxides, have the general configuration:

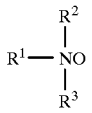

wherein $R^1$ is $C_{6-24}$ alkyl, and $R^2$ and $R^3$ are both $C_{1-4}$ alkyl, or $C_{1-4}$ hydroxyalkyl, although $R^2$ and $R^3$ do not have to be equal. These amine oxides can also be ethoxylated or propoxylated. The preferred amine oxide is lauryl amine oxide. The commercial sources for such amine oxides are Barlox 10, 12, 14 and 16 from Lonza Chemical Company, Varox by Witco and Ammonyx by Stepan Co.

A further preferred semi-polar nonionic surfactant is alkylamidoalkylenedialkylamine oxide. Its structure is shown below:

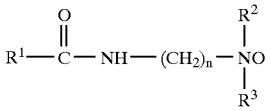

wherein $R^1$ is $C_{5-20}$ alkyl, $R^2$ and $R^3$ are $C_{1-4}$ alkyl,

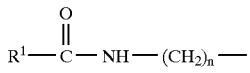

or —$(CH_2)_p$—OH, although $R^2$ and $R^3$ do not have to be equal or the same substituent, and n is 1–5, preferably 3, and p is 1–6, preferably 2–3. Additionally, the surfactant could be ethoxylated (1–10 moles of EO/mole) or propoxylated (1–10 moles of PO/mole). This surfactant is available from various sources, including from Lonza Chemical Company, as a cocoamidopropyldimethyl amine oxide, sold under the brand name Barlox C. Additionally semi-polar surfactants include phosphine oxides and sulfoxides.

The amphoteric surfactant is typically an alkylbetaine or a sulfobetaine. One group of preferred amphoterics are alkylamidoalkyldialkylbetaines. These have the structure:

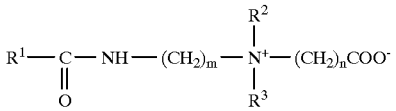

wherein $R^1$ is $C_{6-20}$ alkyl, $R^2$ and $R^3$ are both $C_{1-4}$ alkyl, although $R^2$ and $R^3$ do not have to be equal, and m can be 1–5, preferably 3, and n can be 1–5, preferably 1. These alkylbetaines can also be ethoxylated or propoxylated. The preferred alkylbetaine is a cocoamidopropyldimethyl betaine called Lonzaine CO, available from Lonza Chemical Co. Other vendors are Henkel KGaA, which provides Velvetex AB, and Witco Chemical Co., which offers Rewoteric AMB-15, both of which products are cocobetaines.

The amounts of surfactants present are to be somewhat minimized, for purposes of cost-savings and to generally restrict the dissolved actives which could contribute to leaving behind residues when the aerosol is applied to a surface. However, the amounts added are generally about 0.001–10%, more preferably 0.002–3.00% surfactant. These are generally considered to be cleaning-effective amounts. If a mixture of anionic and nonionic or amphoteric surfactants is used, the ratio of the anionic surfactant to the nonionic or amphoteric surfactant is about 20:1 to 1:20, more preferably about 10:1 to 1:10.

b. Quaternary Ammonium Surfactant

The invention may further optionally include a cationic surfactant, specifically, a quaternary ammonium surfactant. These types of surfactants are typically used in bathroom cleaners because they are generally considered "broad spectrum" antimicrobial compounds, having efficacy against both gram positive (e.g., Staphylococcus sp.) and gram negative (e.g., *Escherischia coli*) microorganisms. Thus, the quaternary ammonium surfactant, or compounds, are incorporated for bacteriostatic/disinfectant purposes and should be present in amounts effective for such purposes.

The quaternary ammonium compounds are selected from mono-long-chain, tri-short-chain, tetraalkyl ammonium compounds, di-long-chain, di-short-chain tetraalkyl ammonium compounds, trialkyl, mono-benzyl ammonium compounds, and mixtures thereof. By "long" chain is meant about $C_{6-30}$ alkyl. By "short" chain is meant $C_{1-5}$ alkyl, preferably $C_{1-3}$. Preferred materials include Stepan series, such as the BTC 2125 series which comprises di-$C_{24}$ tetraalkyl ammonium chloride, Barquat and Bardac series, such as Bardac MB 2050, from Lonza Chemical. Typical amounts of the quaternary ammonium compound range from preferably about 0–5 %, more preferably about 0.001–2%.

3. Chelating Agent

The chelating agent comprises tetraammonium ethylenediamine tetraacetate (referred to as "ammonium EDTA"), tetrapotassium ethylene diaminetetraacetate (referred to as "potassium EDTA"), or mixtures thereof. The chelating agent is a critical part of the invention. Its use, in place of the standard chelating agent, tetrasodium EDTA, results in not only a surprisingly complete removal of various soils, including bathroom soap scum soils, but an unexpectedly rapid removal as well. The fact that the potassium or ammonium salt of EDTA is so effective versus the tetrasodium salt was quite unawaited since, in other literature, the potassium and ammonium salts have not been demonstrated to be superior performers as compared to the tetrasodium salt. Potassium EDTA has an advantage over ammonium EDTA in that the former has low or no odor.

The potassium EDTA can favorably be prepared by taking the acid form of EDTA and neutralizing it with KOH in a stoichiometric quantity. For example, to 50 g of the acid form of EDTA and 47 g deionized water, 76 g of KOH solution (45%) can be slowly added, resulting in a 46% $K_4$EDTA solution. The acid form of EDTA can be obtained from Hampshire Chemicals and Aldrich Chemicals. In the neutralization of the acid form of EDTA, it is preferred to use an excess of alkali. Thus, for example, the level of KOH can vary from a stoichiometric quantity to from about a 0 to 5% excess.

The amount of ammonium EDTA and/or potassium EDTA added should be in the range of 0.01–25%, more preferably 0.01–10%, by weight of the cleaner. Moreover, a discrete quantity of a co-chelant, such as tetrasodium EDTA may be added, in an amount ranging from about 1–5%.

4. Water and Miscellaneous

Since the cleaner is an aqueous cleaner with relatively low levels of actives, the principal ingredient is water, which should be present at a level of at least about 50%, more preferably at least about 80%, and most preferably, at least about 90%. Deionized water is preferred.

Small amounts of adjuncts can be added for improving cleaning performance or aesthetic qualities of the cleaner. For example, buffers could be added to maintain constant pH (which for the invention is between about 7–14, more preferably between about 8–13). These buffers include NaOH, KOH, $Na_2CO_3$, $K_2CO_3$, as alkaline buffers, and phosphoric, hydrochloric, sulfuric acids as acidic buffers, and others. KOH is a preferred buffer since, in the invention, one way of obtaining potassium EDTA is to take the acidic EDTA acid and neutralize it with an appropriate, stoichiometric amount of KOH. Builders, such as phosphates, silicates, and again, carbonates, may be desirable. Further solubilizing materials, such as hydrotropes, e.g., cumene, toluene and xylene sulfonates, may also be desirable. Adjuncts for cleaning include additional surfactants, such as those described in *Kirk-Othmer, Encyclopedia of Chemical Technology*, 3rd Ed., Volume 22, pp. 332–432 (Marcel-Dekker, 1983), and *McCutcheon's Soaps and Detergents* (N. Amer. 1984), which are incorporated herein by reference. Aesthetic adjuncts include fragrances, such as those available from Givaudan, IFF, Quest, Sozio, Firmenich, Dragoco and others, and dyes and pigments which can be solubilized or suspended in the formulation, such as diaminoanthraquinones. Water-insoluble solvents may sometimes be desirable as added grease or oily soil cutting agents. These types of solvents include tertiary alcohols, hydrocarbons (alkanes), pine-oil, d-limonene and other terpenes and terpene derivatives, and benzyl alcohols. Thickeners, such as calcium carbonate, sodium bicarbonate, aluminum oxide, and polymers, such as polyacrylate, starch, xantban gum, alginates, guar gum, cellulose, and the like, may be desired additives. The use of some of these thickeners ($CaCO_3$ or $NaHCO_3$) is to be distinguished from their potential use as builders, generally by particle size or amount used.

5. Propellant

The cleaning composition is delivered in the form of an aerosol. Specifically, in order to apply and build the foam, the cleaning composition is delivered via a gaseous propellant. The propellant comprises, for example, a hydrocarbon, of from 1 to 10 carbon atoms, such as methane, ethane, n-propane, n-butane, isobutane, n-pentane, isopentane, and mixtures thereof. The propellant may also be selected form halogenated hydrocarbons including, for example, fluorocarbons, chlorocarbons, chlorofluorocarbons, and mixtures thereof. Examples of other suitable propellants are founded in P. A. Sanders *Handbook of Aerosol Technology* (Van Nostrand Reinhold Co.)(1979) 2nd Ed., Pgs. 348–353 and 364–367, which are incorporated herein.

A liquified gas propellant mixture comprising about 85% isobutane and 15% propane is preferred because it provides sufficient pressure to expel the cleaning composition from the container and provides good control over the nature of the spray upon discharge of the aerosol formulation. Preferably, the propellants comprises about 3% to 30%, more preferably about 3% to 8%, and most preferably about 3% to 6% of the aerosol formulation.

The aerosol formulation is preferably stored in and dispensed from a pressurized can that is equipped with a nozzle so that an aerosol of the formulation can be readily sprayed onto a surface to create a relatively uniform layer of foam. A preferred nozzle is a toggle valve model ST-76 with an orifice size of 0.016 in. (0.4 mm) that is manufactured by Seaquist Perfect Dispensing, Cary, Ill. Dispensers are known in the art and are described, for example, in U.S. Pat. Nos. 4,780,100, 4,652,389, and 3,541,581 which are incorporated herein. Although pressure within the dispenser, i.e., can pressure, does not appear to be critical, a preferred range is about 40 to 58 lbs./in$^2$, more preferably 40 to 50 lbs./in$^2$, and most preferably 40 to 47 lbs./in$^2$ at 70° F. (21° C.).

The corrosion inhibitor is used to prevent or at least reduce the rate of corrosion of a metallic dispenser. Quaternary ammonium surfactants, if present, can cause corrosion. Preferred corrosion inhibitors include, for example: amine neutralized alkyl acid phosphates, amine neutralized alkyl acid phosphates and nitroalkanes, amine neutralized alkyl acid phosphates and volatile amines, diethanolamides and nitroalkanes, amine carboxylates and nitroalkanes, esters, volatile silicones, amines and mixtures thereof. Specific inhibitors include, for example, sodium lauroyl sarcosinate, sodium meta silicate, sodium benzoate, triethanolamine, and morpholine. To provide additional protection, the interior of the dispenser in contact with the cleaning composition can be coated with an epoxy phenolic coating. When employed, the corrosion inhibitor preferably comprises about 0.1% to 1%, more preferably about 0.1% to 0.8%, and most preferably about 0.35% of the aerosol formulation. Preferably, with addition of the corrosion inhibitor, the pH of the aerosol formulation is greater than 9.5.

In loading the dispenser, the non-propellant components of the aerosol formulation are mixed into a concentrate and loaded into the dispenser first. Thereafter, the liquefied gaseous propellant is inserted before the dispenser was fitted with a nozzle.

EXPERIMENTAL

In the following experiments, inventive aerosol formulations were compared with two commercial bathroom aerosol cleaners, namely, Dow Bathroom Cleaner (Dow Brands) and Lysol Basin Tub & Tile Cleaner (Reckitt & Colman). Table 1 sets forth the non-propellant active components (including corrosium inhibitor) of the two inventive cleaning compositions, one employing potassium EDTA as the chelating agent and the other employing ammonium EDTA.

TABLE 1

| Ingredients | Composition 1 | Composition 2 |
|---|---|---|
| Ethylene glycol monobutyl ether[1] (solvent) | 4.50% | — |
| 2-(2-butoxy ethoxy)[2] (solvent) | — | 2.25% |
| Amine oxide C-12[3] (non-ionic surfactant) | 1.00% | 1.00% |
| Potassium EDTA (chelating agent) | 5.40% | — |
| Ammonium EDTA (chelating agent) | — | 3.00% |
| Quaternary ammonium[4] | 0.28% | 0.28% |
| Sodium lauroyl sarcosinate[5] (corrosion inhibitor) | 1.0% | — |
| Sodium benzoate (corrosion inhibitor) | 0.57% | 0.57% |
| DPNB[6] | — | 2.25% |
| Sodium xylene sulfonate (coupling agent) | — | 1.40% |
| Potassium carbonate | 0.1% | — |
| NaOH | — | 1.21% |
| Fragrance | 0.25% | 0.25% |
| D.I. water | balance | balance |

[1]Butyl Carbitol (Dow)
[2]Butyl Cellosolve (Dow)
[3]Barlox 12 (Lonza)
[4]Stepan BTC 2125M (Lonza)
[5]Maprosyl 30 (Stepan)
[6]Diproproylene glycol ether added for VOC compliance.

Preparation of Bathroom Soil (Protocol I)

A laboratory soil (CSMA No. D-5343-93) combining sebum, dirt and soap scum precipitate was prepared. This is a mixture of potting soil, synthetic sebum (mixture of saturated and unsaturated long chain fatty acids, paraffm, cholesterol and sperm wax, among other materials) and stearate premix (calcium stearate, magnesium stearate and iron stearate). The laboratory soil was applied to pre-baked white tiles and dried in an oven at 75–80° C. for one hour.

Preparation of Simulated Aged Soap Scum (Protocol II)

This laboratory soil (modified from Industry accepted standards) simulates aged soap scum and was prepared by making a calcium stearate suspension (ethanol, calcium stearate and water). This soap scum soil was then sprayed onto black ceramic tiles which were baked at 165–170° C. for one hour, then cooled.

Example 1 One Coat Soap Scum

This example employed tiles prepared by the method described in Protocol II to which 2 grams of the aerosol compositions were applied to each tile. After the foam had dissipated, which typically occurred in about 45 seconds, the tile was wiped with a sponge. The tile was visually graded by a panel of expert graders on a 1 to 10 scale, where 1 indicates no soil removal, while 10 indicates complete removal. The observed results are averaged and subject to error analysis using Fisher's least significant difference ("LSD"), with a confidence level of 95%. The results are set forth in Table 2. As is apparent, the inventive aerosol formulations were superior to the comparative aerosol cleansers.

Example 2 Bathroom Soil Removal Test

In this example, a proprietary and automated reader/scrubber was utilized. The reader/scrubber measures % soil removal by calibrating with a clean tile, which would establish 100% clean, versus a completely soiled tile, which would establish a zero % clean. Each soiled tile cleaned by the scrubber is measured during the cleaning by the reader to establish the differences in shading between the initially completely soiled panel and the completely cleaned one. The number of cycles to remove 90% of the bathroom soil were measured. Tiles coated with bathroom soil (Protocol I) were used. 15 grams of the aerosol compositions were applied to a previously wetted sponge on the scrubber. The results are depicted in Table 2. These scores are again within the 95% confidence level. The inventive aerosol formulations clearly and unambiguously outperformed the aerosol commercial cleaners.

Example 3 Soap Scum Removal Test

In this example, tiles prepared by Protocol II were each coated with 15 grams of an aerosol composition and then tested with the reader/scrubber described in Example 2. The number of cycles to remove 90% of the soap scum were measured. The results are depicted in Table 2. These scores are again within the 95% confidence level. The inventive aerosol formulations again clearly and unambiguously outperformed the commercial aerosol cleaners.

TABLE 2

| Product | Ex. 1 Visual Grade | Ex. 2 No. of Cycles For 90% Removal | Ex. 3 |
|---|---|---|---|
| KEDTA | 9 | 4 | 42 |
| Am EDTA | 8.9 | 3 | 40 |
| DOW SB | 5 | 18 | 100 |
| LYSOL BT&T | 6 | 30 | 90 |

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A dispensable composition for bathroom hard surface cleaning with improved bathroom soil removal comprising:

(a) an anionic, nonionic, amphoteric surfactant, and mixtures thereof with optionally, a quaternary ammonium surfactant, the total amount of said surfactant being present from about 0.001–10%;

(b) about 1% to 50% of at least one water-soluble or dispersible organic solvent having a vapor pressure of at least 0.001 mm Hg at 25° C., said at least one organic solvent present in a solubilizing—or dispersion—effective amount and selected from the group consisting of $C_{1-6}$ alkanols, $C_{1-6}$ diols, $C_{3-24}$ alkylene glycol ethers, and mixtures thereof;

(c) at least 1% of a chelating agent selected from the group consisting of tetrapotassium ethylenediamine-tetraacetate (tetrapotassium EDTA), tetraammonium ethylenediamine-tetraacetate (tetraammonium EDTA), and mixtures thereof;

(d) 3–30% of a propellant; and (e) the remainder, water.

2. The composition of claim 1 wherein the chelating agent comprises tetrapotassium EDTA.

3. The composition of claim 1 wherein said surfactant is an anionic surfactant selected from the group consisting of linear or branched $C_{6-14}$ alkylbenzene sulfonates, alkane sulfonates, alkyl sulfates, and mixtures thereof.

4. The composition of claim 1 wherein said surfactant is a nonionic surfactant selected from the group consisting of alkoxylated alkylphenol ethers, alkoxylated alcohols, and semi-polar nonionic surfactants.

5. The composition of claim 4 wherein said nonionic surfactant is a semi-polar nonionic surfactant selected from the group consisting of mono-long-chain alkyl, di-short-chain trialkyl amine oxides, alkylamidodialkyl amine oxides, phosphine oxides and sulfoxides.

6. The composition of claim 5 wherein said nonionic surfactant of (a) is a mono-long-chain, di-short-chain trialkyl amine oxide.

7. The composition of claim 4 wherein said nonionic surfactant is an ethoxylated alkylphenol ether selected from the group consisting of ethoxylated octylphenol ethers, ethoxylated nonylphenol ethers, and mixtures thereof.

8. The composition of claim 7 wherein said nonionic surfactant is an ethoxylated octylphenol, ethoxylated with 1–10 moles of ethylene oxide.

9. The composition of claim 1 wherein said organic solvent of (b) is selected from the group consisting of alkanols, diols, glycol ethers, and mixtures thereof.

10. The composition of claim 9 wherein said organic solvent is a $C_{3-24}$ glycol ether.

11. The composition of claim 1 further comprising a quaternary ammonium compound.

12. The composition of claim 11 wherein said quaternary ammonium compound is selected from the group consisting of mono-long-chain, tri-short-chain, tetraalkyl ammonium compounds, di-long-chain, di-short-chain tetra-alkyl ammonium compounds, trialkyl, mono-benzyl ammonium compounds, and mixtures thereof.

13. The composition of claim 1 further comprising at least one adjunct selected from the group consisting of builders, buffers, fragrances, thickeners, dyes, pigments, foaming stabilizers, water-insoluble organic solvents, and hydrotropes.

14. The composition of claim 1 wherein said tetrapotassium EDTA is prepared by neutralizing the acid form of EDTA.

15. The composition of claim 14 wherein the neutralizing agent is potassium hydroxide.

16. The composition of claim 15 wherein said potassium hydroxide is present in a stoichiometric to slightly greater than stoichiometric amount.

17. The composition of claim 1 further comprising tetrasodium EDTA as a co-chelant.

18. A method for removing bathroom soil from a bathroom hard surface, said method comprising the steps of:

(i) forming a foam by delivering an admixture via a propellant, wherein the admixture and propellant are derived from a composition comprising:

(a) either an anionic, nonionic, amphoteric surfactant, and mixtures thereof with optionally, a quaternary ammonium surfactant, the total amount of said surfactant being present from about 0.001–10%;

(b) about 1% to 50% of at least one water-soluble or dispersible organic solvent having a vapor pressure of at least 0.001 mm Hg at 25° C.;

(c) 0.01–25% of a chelating agent selected from the group consisting of tetrapotassium ethylenediamine-tetraacetate (potassium EDTA), tetraammonium ethylenediamine-tetraacetate (ammonium EDTA), and mixtures thereof;

(d) 3–30% of a propellant; and (e) the remainder, water; and (ii) applying said foam to a soiled bathroom hard surface.

19. The method of claim 18 further comprising removing said bathroom soil and said admixture from said surface.

20. The method of claim 18 wherein the chelating agent is potassium EDTA.

21. A device for dispensing a composition for cleaning soil from a hard surface which comprises:

(i) a closed container containing said composition which comprises:

(a) either an anionic, nonionic, amphoteric surfactant, and mixtures thereof with optionally, a quaternary ammonium surfactant, the total amount of said surfactant being present in a cleaning effective amount;

(b) at least one water-soluble or dispersible organic solvent having a vapor pressure of at least 0.001 mm Hg at 25° C., said at least one organic solvent present in a solubilizing or dispersion—effective amount;

(c) a chelating agent selected from the group consisting of tetrapotassium ethylenediamine-tetraacetate (potassium EDTA) tetra-ammonium ethylene-ammonium-tetraacetate (ammonium EDTA), and mixtures thereof said chelating agent present in an amount effective to enhance soil removal in said composition;

(d) an effective amount of a propellant;

(e) the remainder, water; and (ii) nozzle means for releasing said composition towards the hard surface whereupon non-propellant components admix and interact with said propellant to form a foam on said surface.

* * * * *